US010844854B2

(12) United States Patent
Zhang et al.

(10) Patent No.: US 10,844,854 B2
(45) Date of Patent: Nov. 24, 2020

(54) PUMP FAILURE DIFFERENTIATION SYSTEM

(71) Applicant: Caterpillar Inc., Peoria, IL (US)

(72) Inventors: Yanchai Zhang, Dunlap, IL (US); Zhijun Cai, Dunlap, IL (US); Zhaoxu Dong, Dunlap, IL (US); Xuefei Hu, Mossville, IL (US)

(73) Assignee: Caterpillar Inc., Peoria, IL (US)

( * ) Notice: Subject to any disclaimer, the term of this patent is extended or adjusted under 35 U.S.C. 154(b) by 625 days.

(21) Appl. No.: 15/412,630

(22) Filed: Jan. 23, 2017

(65) Prior Publication Data

US 2018/0209415 A1 Jul. 26, 2018

(51) Int. Cl.
*F04B 51/00* (2006.01)
*F04B 15/04* (2006.01)
(Continued)

(52) U.S. Cl.
CPC ..... *F04B 51/00* (2013.01); *F04B 15/04* (2013.01); *F04B 17/05* (2013.01); *F04B 17/06* (2013.01);
(Continued)

(58) Field of Classification Search
CPC ..... F04B 51/00; F04B 49/103; F04B 49/06; F04B 49/02; F04B 15/04; F04B 17/06;
(Continued)

(56) References Cited

U.S. PATENT DOCUMENTS 6,167,965 B1 1/2001 Bearden et al.
6,882,960 B2 * 4/2005 Miller ..... F04B 51/00 702/177
(Continued)

FOREIGN PATENT DOCUMENTS

WO WO 2015/167532 A1 11/2015
WO WO 2016/019219 A1 2/2016
(Continued)

OTHER PUBLICATIONS

"Reciprocating Pump System Dynamic Analysis" (Nov. 9, 2009) WRDS, Inc. (available at http://wres.us/Downloads.html).†
(Continued)

*Primary Examiner* — Connor J Tremarche
(74) *Attorney, Agent, or Firm* — Leydig, Voit & Mayer, LTD.

(57) ABSTRACT

A pump monitoring and notification system for a hydraulic pump includes an accelerometer and a controller. The accelerometer is associated with the hydraulic pump and is disposed relative to the hydraulic pump to generate acceleration data indicative of acceleration of the hydraulic pump. The controller is configured to access a fault threshold, access a time threshold, and determine an acceleration of the accelerometer based upon the acceleration data from the accelerometer. The controller is further configured to determine an RMS average of the acceleration of the accelerometer based upon the acceleration of the hydraulic pump, compare the RMS average of the acceleration of the accelerometer to the fault threshold, and generate an alert signal when the RMS average of the acceleration of the accelerometer exceeds the fault threshold for a time period exceeding the time threshold.

12 Claims, 7 Drawing Sheets

(51) Int. Cl.

| | |
|---|---|
| ***F04B 17/05*** | (2006.01) |
| ***F04B 19/22*** | (2006.01) |
| ***F04B 49/02*** | (2006.01) |
| ***F04B 19/06*** | (2006.01) |
| ***F04B 17/06*** | (2006.01) |
| ***F04B 49/06*** | (2006.01) |
| ***F04B 49/10*** | (2006.01) |

(52) U.S. Cl.
CPC ..... *F04B 19/22* (2013.01); *F04B 49/02* (2013.01); *F04B 49/06* (2013.01); *F04B 49/103* (2013.01); *F04B 2201/0203* (2013.01)

(58) Field of Classification Search
CPC ... F04B 17/05; F04B 19/22; F04B 2201/0203
USPC ..... 417/63
See application file for complete search history.

(56) References Cited

U.S. PATENT DOCUMENTS

| | | | | |
|---|---|---|---|---|
| 7,693,684 | B2 * | 4/2010 | Halbinger | F04B 51/00 417/53 |
| 8,870,554 | B2 | 10/2014 | Kent | |
| 8,950,482 | B2 | 2/2015 | Hill et al. | |
| 9,027,636 | B2 | 5/2015 | Gilstad et al. | |
| 9,217,318 | B2 | 12/2015 | Dusterhoft et al. | |
| 9,260,959 | B2 | 2/2016 | Beisel et al. | |
| 2008/0010030 | A1 * | 1/2008 | Cheung | G05B 23/0232 702/34 |
| 2010/0189580 | A1 * | 7/2010 | Kyllingstad | F04B 51/00 417/437 |
| 2015/0159537 | A1 | 6/2015 | Ludeman et al. | |
| 2015/0308244 | A1 | 10/2015 | Cardamone et al. | |
| 2015/0330385 | A1 * | 11/2015 | Lofstrom | F04B 43/12 417/53 |
| 2016/0102537 | A1 | 4/2016 | Lopez | |
| 2016/0168953 | A1 | 6/2016 | Zhang et al. | |
| 2016/0168976 | A1 | 6/2016 | Zhang et al. | |
| 2016/0168979 | A1 | 6/2016 | Zhang et al. | |
| 2016/0194942 | A1 | 7/2016 | Wiegman et al. | |
| 2016/0195082 | A1 | 7/2016 | Wiegman et al. | |
| 2016/0290130 | A1 | 10/2016 | Neale et al. | |
| 2016/0356270 | A1 | 12/2016 | Zhang et al. | |

FOREIGN PATENT DOCUMENTS

| | | |
|---|---|---|
| WO | WO 2016/160459 A2 | 10/2016 |
| WO | WO 2016/176531 A1 | 11/2016 |

OTHER PUBLICATIONS

"Pump Inspector Monitor System" (Sep. 21, 2010) WRDS, Inc. (Available at http://wres.us/Downloads.html).†

* cited by examiner
† cited by third party

PUMP FAILURE DIFFERENTIATION SYSTEM

TECHNICAL FIELD

This application relates generally to a monitoring system and, more particularly, to a system and method of monitoring the performance of a hydraulic pump and generating a notification upon a failure of the pump.

BACKGROUND

Hydraulic fracturing or fracking operations are often used during well development in the oil and gas industry. For example, in formations in which oil or gas cannot be readily or economically extracted from the earth, a hydraulic fracturing operation may be performed. Such a hydraulic fracturing operation typically includes pumping large amounts of fracking fluid at high pressure to induce cracks in the earth, thereby creating pathways via which the oil and gas may flow. Hydraulic fracturing or fracking pumps are typically relatively large positive displacement pumps. Fracking fluid often contains water, proppants and other additives and is pumped downhole by the fracking pump at a sufficient pressure to cause fractures and fissures to form within the well.

As a result of the abrasive and sometimes corrosive nature of the fracking fluid and the high pressures to which the fracking pumps are subjected, fracking pumps may be at a relatively high risk of failure. Systems have been proposed for monitoring pump failures. For example, U.S. Patent Publication No. 2016/0168976 discloses a system for detecting leakage in a fracking by monitoring the suction pressure, the discharge pressure, and a pump cylinder pressure. Each pressure may be measured by a different pressure sensor. A simplified system for monitoring a fracking pump would be desirable.

The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

SUMMARY

In one aspect, a pump monitoring and notification system for a hydraulic pump includes an accelerometer and a controller. The accelerometer is associated with the hydraulic pump and is disposed relative to the hydraulic pump to generate acceleration data indicative of acceleration of the hydraulic pump. The controller is configured to access a fault threshold, access a time threshold, and determine an acceleration of the accelerometer based upon the acceleration data from the accelerometer. The controller is further configured to determine a root mean square ("RMS") average of the acceleration of the accelerometer based upon the acceleration of the hydraulic pump, compare the RMS average of the acceleration of the accelerometer to the fault threshold, and generate an alert signal when the RMS average of the acceleration of the accelerometer exceeds the fault threshold for a time period exceeding the time threshold.

In another aspect, a method of monitoring a hydraulic pump includes accessing a fault threshold, accessing a time threshold, and receiving acceleration data from an accelerometer associated with the hydraulic pump, with the accelerometer being disposed relative to the hydraulic pump whereby the acceleration data is indicative of acceleration of the hydraulic pump. The method further includes determining an acceleration of the accelerometer based upon the acceleration data from the accelerometer, determining an RMS average of the acceleration based upon the acceleration of the hydraulic pump, comparing the RMS average of the acceleration of the accelerometer to the fault threshold, and generating an alert signal when the RMS average of the acceleration of the accelerometer exceeds the fault threshold for a time period exceeding the time threshold.

In still another aspect, a pumping system includes a prime mover, a transmission operatively connected to and driven by the prime mover, a hydraulic pump operatively connected to and driven by the transmission, an accelerometer associated with the hydraulic pump, and a controller. The accelerometer is disposed relative to the hydraulic pump to generate acceleration data indicative of acceleration of the hydraulic pump. The controller is configured to access a fault threshold, access a differentiation threshold, access a time threshold, determine an acceleration of the accelerometer based upon the acceleration data from the accelerometer, and determine an RMS average of the acceleration based upon the acceleration of the hydraulic pump. The controller is further configured to compare the RMS average of the acceleration of the accelerometer to the fault threshold, and when the RMS average of the acceleration of the accelerometer exceeds the fault threshold for a time period exceeding the time threshold, determine an RMS peak-to-peak value of the acceleration of the accelerometer based upon the acceleration of the hydraulic pump. The controller also is configured to compare the RMS peak-to-peak value of the acceleration of the accelerometer to the differentiation threshold and generate a leak alert signal when the RMS peak-to-peak value of the acceleration of the accelerometer exceeds the differentiation threshold and generate a cavitation alert signal when the RMS peak-to-peak value is less the differentiation threshold.

DETAILED DESCRIPTION

Figure 1:
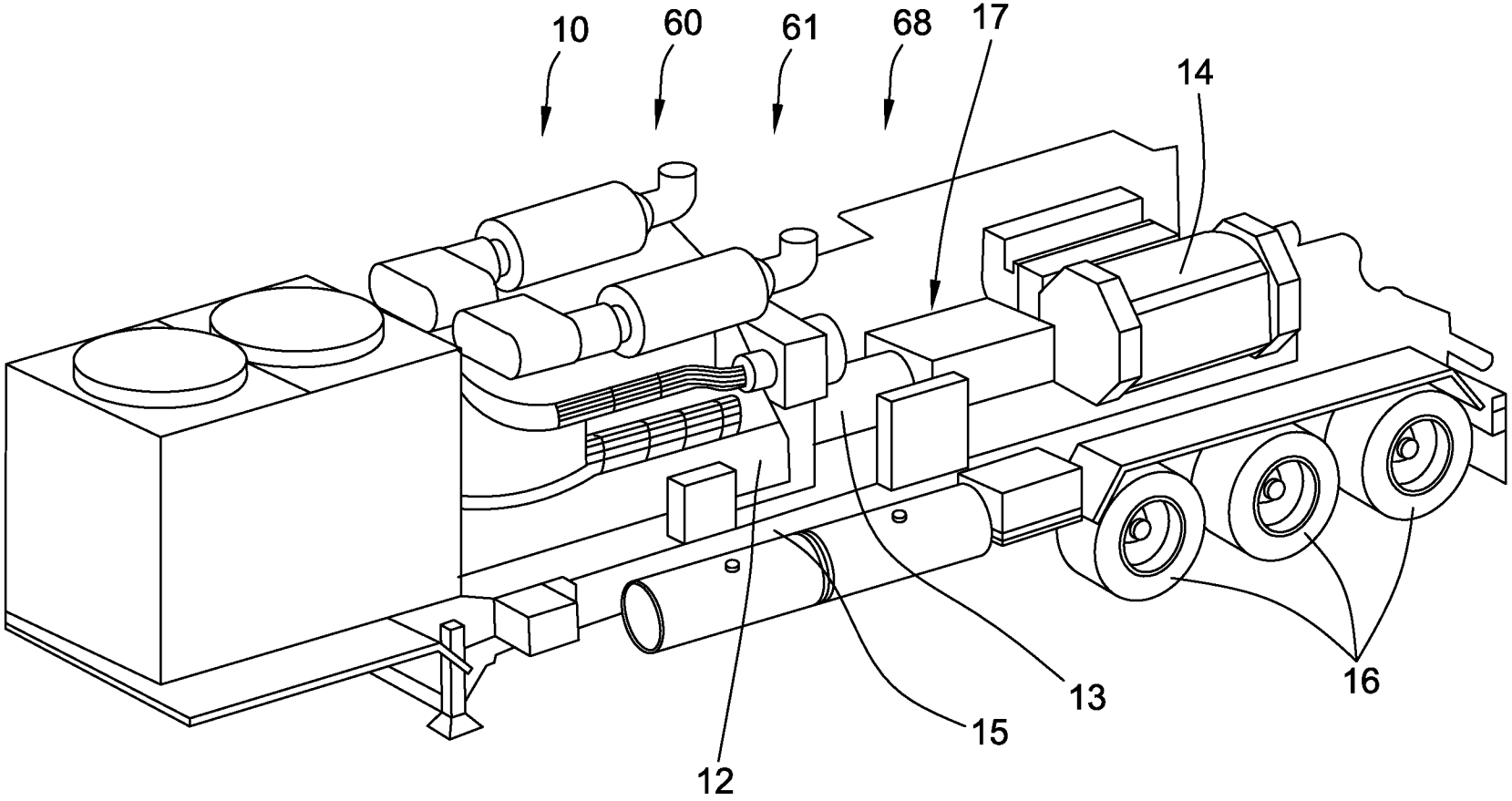
FIG. 1 is a perspective view of a pumping system supported on a trailer for transportation.

Referring to FIG. 1, an example of a pumping system 10 is illustrated that is particularly suited for use with geological fracturing processes to recover oil and/or natural gas from the earth. The pumping system 10 may include a prime mover such as an internal combustion engine 12, a transmission 13 that is operatively connected to and driven by engine 12, and a hydraulic pump 14 that is operatively connected to and driven by the transmission 13. In one example, the engine 12 may be a compression ignition engine that combusts diesel fuel. The hydraulic pump 14 may be configured to pump hydraulic or fracking fluid into the ground to fracture rock layers during the fracturing process. Because the fracturing process may require introduction of hydraulic fluids at different locations about the fracturing site, the components of the pumping system 10 may be supported on a mobile trailer 15 disposed on wheels 16 to enable transportation of the system about the fracturing site.

The transmission 13 may be configured with a plurality of gears operative between the engine 12 and the output shaft (not shown) of the transmission to alter the rotational speed of the output from the engine. In some instances, a fixed gear mechanism or coupling depicted generally at 17 may be provided between the output shaft of the transmission 13 and the drive shaft 21 of the hydraulic pump 14 to further change or reduce the rotational speed between the engine 12 and the pump.

Figure 2:
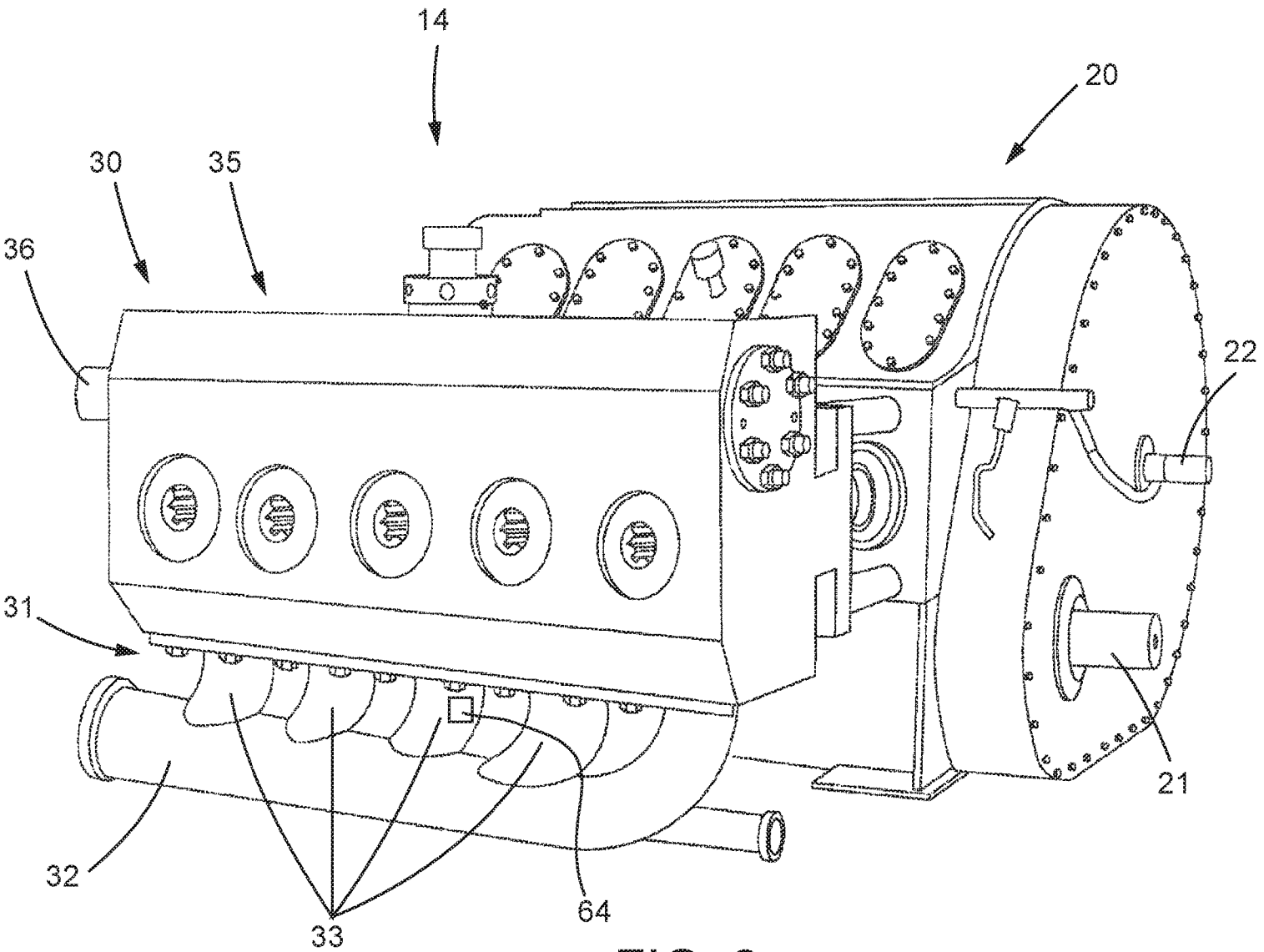
FIG. 2 is a perspective view of a hydraulic pump of the pumping system depicted in FIG. 1.

As depicted in FIG. 2, hydraulic pump 14 includes a power section 20 and a fluid section 30. The power section 20 may include an input or drive shaft 21 operatively connected to and driven by the transmission 13. The drive shaft 21 may be operatively connected to an additional shaft 22 through gears (not shown) or other structure or mechanisms to convert rotational movement of the driveshaft into a linear movement at the fluid section 30 of the hydraulic pump 14.

Figure 3:
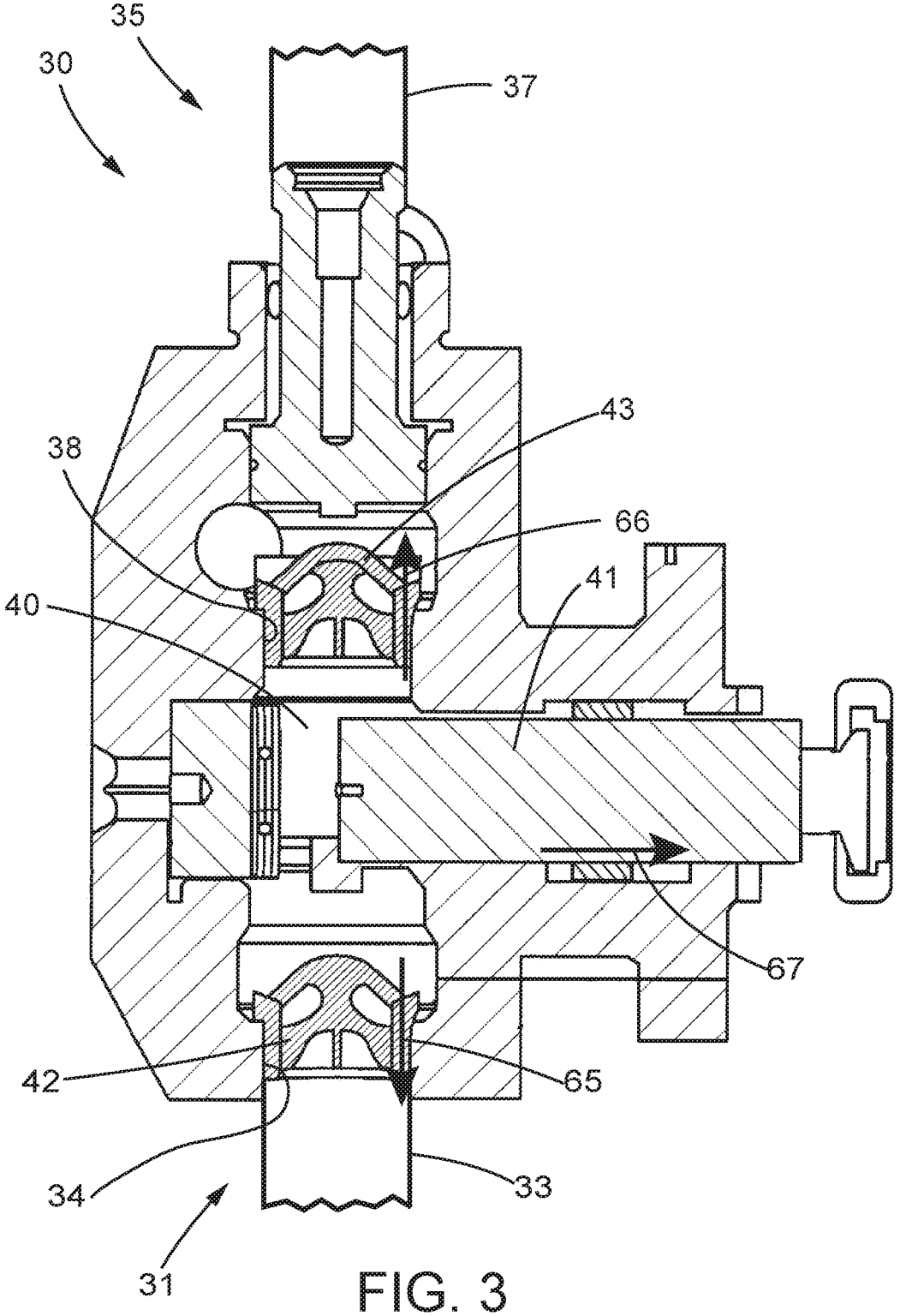
FIG. 3 is a sectional view of a portion of the fluid section of the hydraulic pump depicted in FIG. 2.

Referring to FIG. 3, the fluid section 30 may include an inlet end 31 and an outlet end 35, spaced from the inlet end, with one or more cylinders 40 disposed between the inlet end and the outlet end. Each cylinder 40 may include a reciprocating member such as a piston 41 disposed for reciprocating sliding movement therein.

Referring to FIG. 2, an inlet conduit (not shown) may be fluidly connected to an inlet manifold 32 positioned at the inlet end 31. The inlet manifold 32 may include a plurality of inlet lines 33 with each inlet line being fluidly connected to one of the cylinders 40. The inlet end 31 may include a suction or inlet valve 42 (FIG. 3) positioned along inlet wall 34 between each inlet line 33 and its associated cylinder 40. In one embodiment, the inlet valve 42 may be biased in a closed condition or position and moved to its open position to permit fracking fluid to pass therethrough upon the piston 41 generating a sufficient vacuum or negative pressure.

A discharge or outlet conduit (not shown) may be fluidly connected to an outlet manifold 36 positioned at the outlet end 35. The outlet manifold may include a plurality of outlet lines 37 with each outlet line being fluidly connected to one of the cylinders 40, such as at a location opposite the inlet lines 33. The outlet end 35 may include a discharge or outlet valve 43 (FIG. 3) positioned along outlet wall 38 between each outlet line 37 and its associated cylinder 40. In one embodiment, the outlet valve 43 may be biased in a closed condition or position and moved to its open position to permit fracking fluid to pass therethrough upon the piston 41 generating a sufficient or high enough pressure.

During a pumping process, operation of the engine 12 may drive rotation of the transmission 13 and ultimately rotation of the drive shaft 21 of the hydraulic pump 14. Rotation of the drive shaft 21 causes reciprocating movement of the pistons 41 within cylinders 40. The reciprocating movement of the pistons 41 may cause fracking fluid to be drawn through the inlet manifold 32 from the inlet conduit (not shown) and into the cylinders 40 through the inlet lines 33 and past the inlet valves 42. Fracking fluid is driven by the pistons 41 past the outlet valves 43 through the outlet lines 37 and into outlet manifold 36.

The pumping system 10 may be controlled by the control system 60 as shown generally by an arrow in FIG. 1 indicating association with the pumping system. The control system 60 may include an electronic control module or controller 61 as shown generally by an arrow in FIG. 1 and a plurality of sensors. The controller 61 may control the operation of various aspects of the pumping system 10.

The controller 61 may be an electronic controller that operates in a logical fashion to perform operations, execute control algorithms, store, retrieve, and access data and other desired operations. The controller 61 may include or access memory, secondary storage devices, processors, and any other components for running an application. The memory and secondary storage devices may be in the form of read-only memory (ROM) or random access memory (RAM) or integrated circuitry that is accessible by the controller. Various other circuits may be associated with the controller 61 such as power supply circuitry, signal conditioning circuitry, driver circuitry, and other types of circuitry.

The controller 61 may be a single controller or may include more than one controller disposed to control various functions and/or features of the pumping system 10. The term "controller" is meant to be used in its broadest sense to include one or more controllers and/or microprocessors that may be associated with the pumping system 10 and that may cooperate in controlling various functions and operations of the pumping system. The functionality of the controller 61 may be implemented in hardware and/or software without regard to the functionality. The controller 61 may rely on one or more data maps relating to the operating conditions and the operating environment of the pumping system 10 and the work site at which the pumping system is operating that may be stored in the memory of or associated with the controller. Each of these data maps may include a collection of data in the form of tables, graphs, and/or equations.

The control system 60 and controller 61 may be located on the trailer 15 or may be distributed with components also located remotely from or off-board the trailer.

Pumping system 10 may be equipped with a plurality of sensors that provide data indicative (directly or indirectly) of various operating parameters of elements of the system and/or the operating environment in which the system is operating. The term "sensor" is meant to be used in its broadest sense to include one or more sensors and related components that may be associated with the pumping system 10 and that may cooperate to sense various functions, operations, and operating characteristics of the element of the system and/or aspects of the environment in which the system is operating.

An engine speed sensor 62 (FIG. 4) may be provided on or associated with the engine 12 to monitor the output speed of the engine. The engine speed sensor 62 may generate engine speed data indicative of the output speed of engine 12. The engine speed sensor 62 may be used to determine whether the engine is operating at a steady state. Other manners (e.g., combinations of other sensors) may be used as a speed sensor to generate speed data indicative of the engine speed or whether the engine is operating at a steady state. A transmission speed sensor 63 (FIG. 4) may be provided on or associated with the transmission 13 to monitor the output speed of the transmission. The transmission speed sensor 63 may generate transmission speed data indicative of the output speed of transmission 13. In some instances, the output speed of the transmission 13 may be used to determine the rotational speed of the hydraulic pump 14.

An accelerometer 64 (FIG. 2) may be provided on or associated with the hydraulic pump 14 or components connected to the hydraulic pump to monitor vibrations of the hydraulic pump. The accelerometer 64 may generate acceleration data or signals indicative of the acceleration of the hydraulic pump 14 or the component connected to the pump.

As depicted, the accelerometer 64 may be positioned on an inlet line 33 of the inlet manifold 32 near the longitudinal center of the inlet manifold. Other locations for the accelerometer are contemplated. For example, in some embodiments, the accelerometer 64 may be positioned on any of the inlet lines 33 or along other portions of the inlet manifold 32. In other embodiments, the accelerometer 64 may be positioned at other locations along the fluid section 30 of the hydraulic pump 14 or other components operatively connected to the hydraulic pump insufficient proximity so that vibrations experienced by the accelerometer will be indicative of vibrations experienced by the hydraulic pump. Although depicted with a single accelerometer 64, additional accelerometers could be utilized on or associated with the hydraulic pump 14.

In one example, the accelerometer 64 may be a Piezoelectric accelerometer. The use of other types of accelerometers is contemplated. In some embodiments, the accelerometer 64 may be a multi-axis accelerometer. In other embodiments, the accelerometer may be a single axis accelerometer.

The abrasive and/or corrosive nature of the fracking fluid being pumped may cause substantial wear on the components of the hydraulic pump 14 and, in particular, the fluid section 30. Leaks may be likely to occur along the inlet wall or at the inlet valve 42 as indicated by the arrow 65 in FIG. 3, along the outlet wall or at the outlet valve 43 as indicated by the arrow 66, and/or along the path of the piston 41 through cylinder 40 as indicated by the arrow 67. Such leaks may reduce the performance of the hydraulic pump 14 and may be indicative of more significant future failures.

In addition to avoiding leaks in the hydraulic pump 14, it is desirable to avoid cavitation within the pump. Cavitation may be caused by various conditions including leaks as described above as well as low pressure or low flow at the inlet end 31. In addition to reduced performance of the hydraulic pump 14, cavitation may also cause significant damage to the pump.

The control system 60 may include a pump monitoring and notification system 68 as shown generally by an arrow in FIG. 1 that monitors aspects of the operation of the pumping system 10. The pump monitoring and notification system 68 may monitor the operation of the pumping system 10 to determine whether the hydraulic pump 14 is leaking or experiencing cavitation. In doing so, upon the pumping system 10 meeting specified operating conditions, the pump monitoring and notification system 68 may analyze the acceleration of the hydraulic pump 14 or components mounted there on or thereto to determine whether the performance of the pump is within a desired operating range.

During operation, the hydraulic pump 14 may undergo or experience a certain amount of vibrations or movement, even under steady state operating conditions with no leakage or cavitation. Such vibrations or movement may vary or increase as the rotational speed of the hydraulic pump 14 increases. Vibrations or movement in excess of the expected vibrations or movement associated with steady state operation at a particular rotational speed may occur when the hydraulic pump 14 is leaking or experiencing cavitation. In other words, upon the occurrence of a fault condition such as leakage or cavitation, the hydraulic pump 14 may experience an increase in vibrations or movement.

As used herein, "steady state" refers to maintaining a constant or generally constant average speed. Since the acceleration data from the accelerometer 64 may be affected by the rotational speed of the hydraulic pump 14, the hydraulic pump should be operating in a steady state manner while operating the pump monitoring and notification system 68. Steady state operation of the pumping system 10 may be determined in any desired manner including monitoring the rotational speed of the engine 12, monitoring the rotational speed of the transmission 13, monitoring the rotational speed of the hydraulic pump 14, or monitoring other factors or sensors indicative of the operating characteristics of the pumping system.

Figure 5:
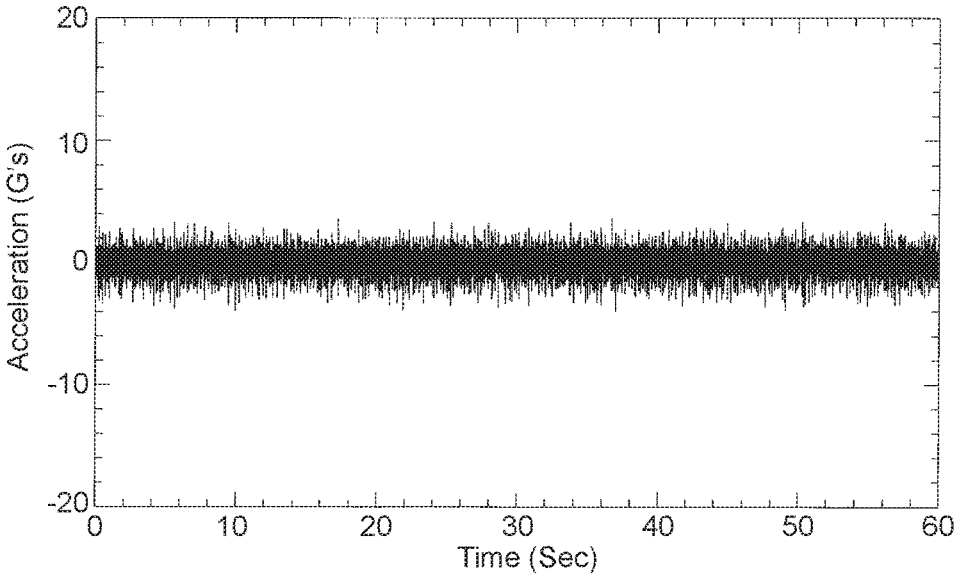
FIG. 5 is an exemplary graph of the vibrations associated with a hydraulic pump without a fault condition.
Figure 6:
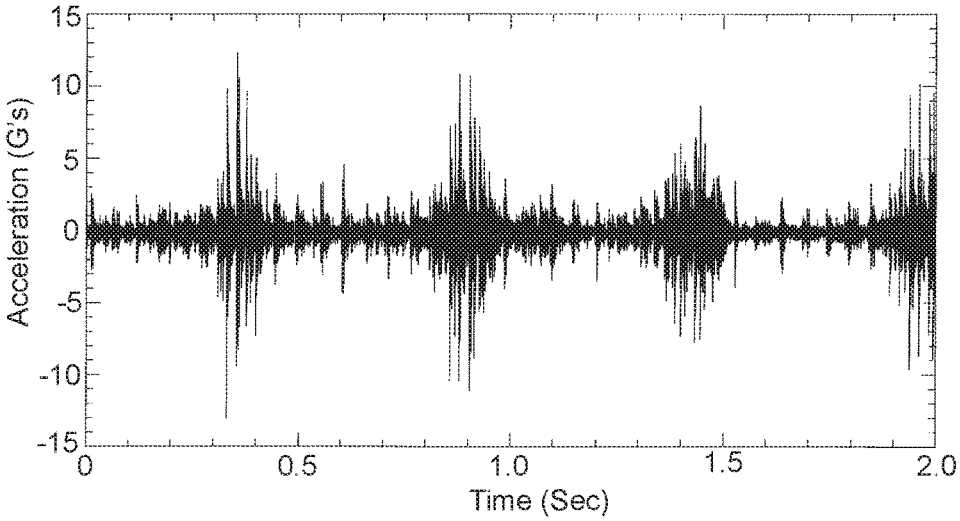
FIG. 6 is an exemplary graph of the vibrations associated with a hydraulic pump experiencing leakage.
Figure 7:
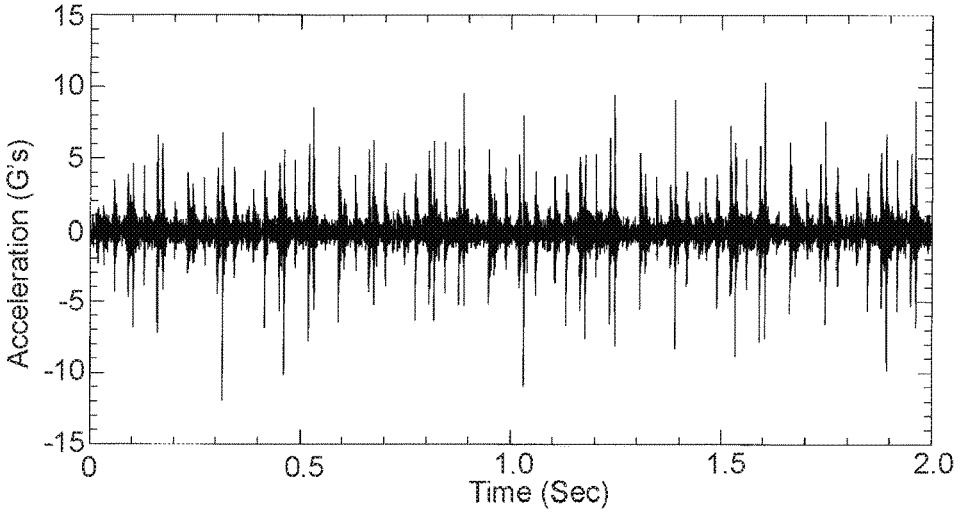
FIG. 7 is an exemplary graph of the vibrations associated with a hydraulic pump experiencing cavitation.

As an example, FIG. 5 depicts the readings from an accelerometer 64 on an inlet line 33 near the longitudinal centerline of the inlet manifold 32 of a hydraulic pump 14 during normal or steady state operation of the pump with no leaking or cavitation. FIG. 6 depicts the readings from the same accelerometer 64 during normal or steady state operation but with the hydraulic pump 14 experiencing leakage. FIG. 7 depicts the readings from the same accelerometer 64 during normal or steady state operation but with the hydraulic pump 14 experiencing cavitation.

Based upon the acceleration data signals from the accelerometer 64 during steady-state operation of pumping system 10, the pump monitoring and notification system 68 may determine not only whether the hydraulic pump 14 is experiencing a fault condition, but also may differentiate between a leakage condition and cavitation. To do so, the accelerometer 64 is used with a relatively high frequency sampling rate. In one example, the sampling rate may be 10 kHz. In another example, the sampling rate may be at least 5 kHz. As used herein, a sampling rate of at least 5 kHz means a sampling rate with a frequency of 5 kHz or more such as 5 kHz, 10 kHz or other frequencies greater than 5 kHz. Other sampling rates are contemplated. In some embodiments, a sampling rate of less than 5 kHz may not provide enough differentiation between the acceleration data to permit the pump monitoring and notification system 68 may operate as desired.

The pump monitoring and notification system 68 operates by analyzing, while the pumping system 10 is operating in a steady-state condition, the acceleration data from the accelerometer 64 in a first manner to determine whether a fault condition exists and then analyzes the data in a second manner to determine the type of fault. More specifically, the pump monitoring and notification system 68 calculates the RMS average of the acceleration or vibration measured by the accelerometer 64 (and thus that of the hydraulic pump 14) for a specified time period and compares the RMS average for that time period to a fault threshold. In one example, the specified time period may be equal to the time required for one rotation of the hydraulic pump 14. In other words, the pump monitoring and notification system 68 calculates the RMS average of the acceleration for each rotation of the hydraulic pump 14 and compares it to the fault threshold. In many fracking operations, the typical hydraulic pump 14 will rotate at a rate of up to 300 RPM.

Figure 8:
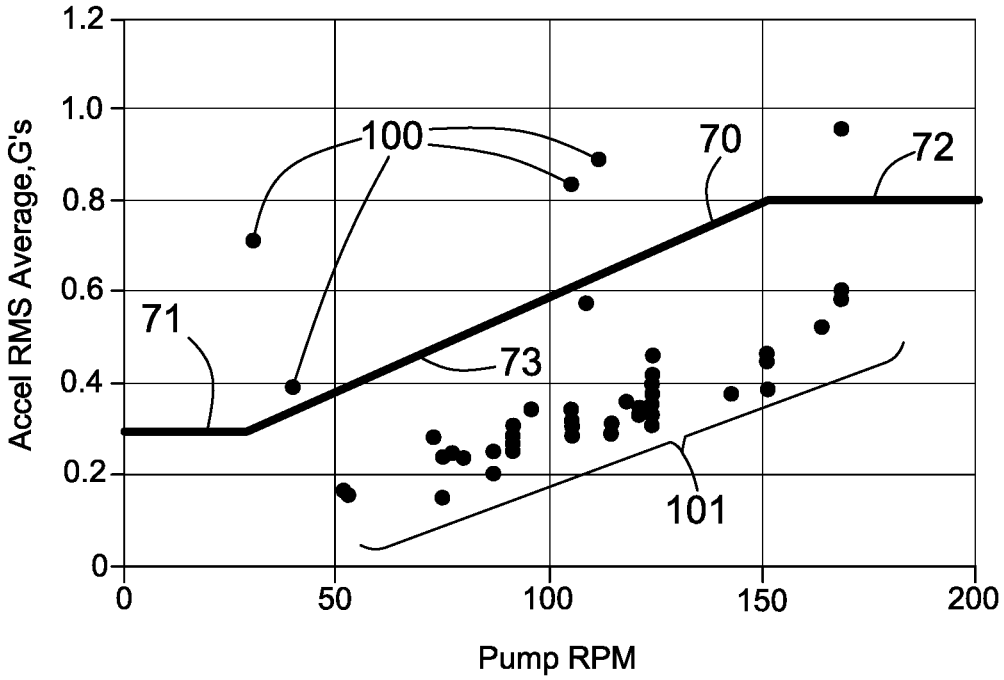
FIG. 8 is an exemplary graph of RMS average acceleration as a function of pump RPM.

It should be noted that the vibrations of the hydraulic pump 14 may vary depending upon the rotation rate of the pump while operating in a steady-state condition. Accordingly, the fault threshold may be dynamic or vary based on the rotational speed of the pump. For example, referring to FIG. 8, a plurality of data points 100, 101 are plotted depicting their RMS average acceleration versus the rotational speed of the hydraulic pump 14. The fault threshold 70, as depicted, includes a first flat or constant section 71 applicable at relatively low rotation rates, a second flat or constant section 72 applicable at relatively high rotation rates, and a section 73 that increases linearly between the two constants sections 71, 72. Other configurations of the fault threshold are contemplated. Data points 100 above the fault threshold 70 indicate a faulty hydraulic pump 14 and data points 101 below the fault threshold indicate a healthy or properly operating pump.

Once the pump monitoring and notification system 68 has detected that the hydraulic pump 14 has a fault condition, the pump monitoring and notification system may be used to determine whether the fault condition is a leaking pump or cavitation. To do so, the pump monitoring and notification system 68 calculates the RMS peak-to-peak value of the acceleration or vibration measured by the accelerometer 64 (and thus that of the hydraulic pump 14) for a specified time period and compares the RMS peak-to-peak value for that time period to a differentiation threshold. As with the example described above, the specified time period may be equal to the time required for one rotation of the hydraulic pump 14.

Figure 9:
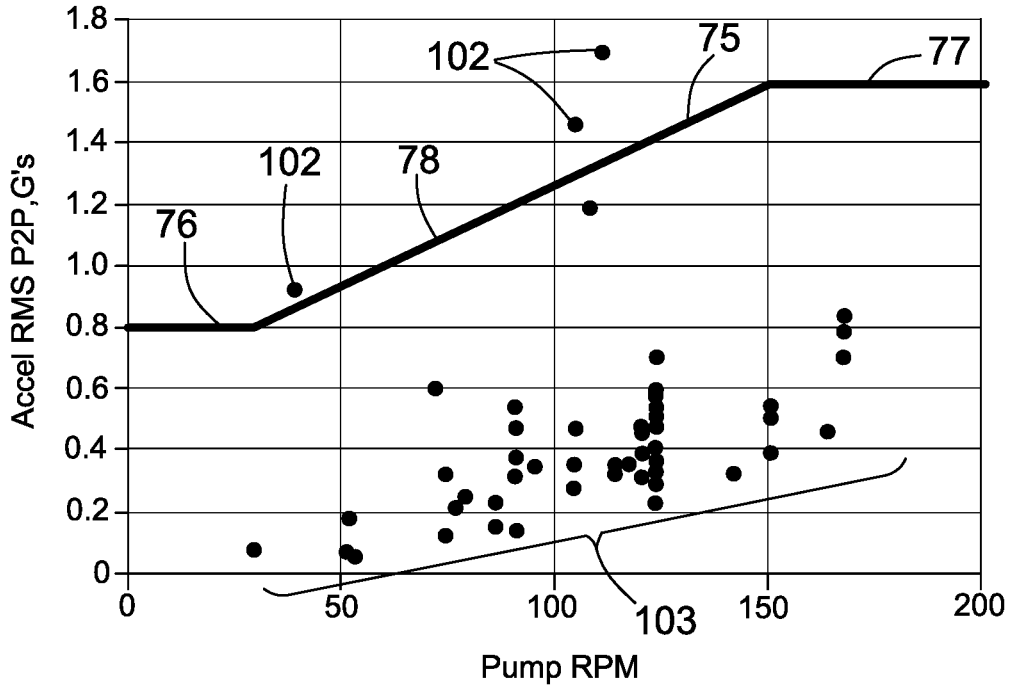
FIG. 9 is an exemplary graph of RMS peak-to-peak acceleration as a function of pump RPM.

As described above, the vibrations of the hydraulic pump 14 may vary depending upon the rotation rate of the pump. Accordingly, the differentiation threshold may also vary or be dynamic based upon the rotational speed of the hydraulic pump 14. For example, referring to FIG. 9, a plurality of data points 102, 103 are plotted depicting the RMS peak-to-peak acceleration versus the rotation speed of the hydraulic pump 14. The differentiation threshold 75 is depicted as being similar to the fault threshold 70 described above with a first flat or constant section 76 applicable at relatively low rotation rates, a second flat or constant section 77 applicable at relatively high rotation rates, and a section 78 that increases linearly between the two constants sections 76, 77. Other configurations of the differentiation threshold are contemplated. Data points 102 above the differentiation threshold 75 indicate a leaking hydraulic pump 14 and data points 103 below the differentiation threshold indicate pump cavitation. Upon determining that a fault condition exists and determining the type of fault, the controller 61 may generate an alert signal. More specifically, data points 102 above the differentiation threshold 75 may result in a leakage alert signal being generated and data points 103 below the differentiation threshold may result in a cavitation alert signal being generated.

As described above, the sampling rate required for the accelerometer 64 may be relatively high as compared to the requirements of other sensors associated with the pumping system 10. As a result, an engine control module, that may form a portion of or constitute the entire controller 61, may operate at a slower processing speed or may only be capable of a sampling rate lower than the relatively high frequency sampling data required by the pump monitoring and notification system 68 for the accelerometer 64. In such case, the controller 61 may include a first component or first processor 80 (FIG. 4) that operates at a first rate and a second component or second processor 81 that operates at a second, faster rate that is operative to perform the necessary operations with respect to the acceleration data from the accelerometer 64. In one embodiment, the second processor 81 may be a field programmable gate array that is included within an engine control module.

As an example, a typical engine control module may be configured for sampling rates of approximately 1.0 ms or slower. In some applications, the required sampling rate for some sensors may be as slow as 10 or 100 ms. It is believed that the sampling rate for the acceleration data from the accelerometer 64 must be at least 5 kHz or 0.2 ms. If the data from the accelerometer 64 is sampled at a slower rate or frequency, the distinctions between the vibrations or movement of the hydraulic pump 14 may not be identified. Accordingly, the controller 61 may utilize a second processor 81 that has a faster processing speed or sampling rate than the engine control module in order to process the acceleration data from the accelerometer 64.

In one embodiment, the controller 61 may be configured to utilize the second processor 81 to initially process (or pre-process) the acceleration data from the accelerometer 64 to generate data that may be used by other portions of the controller with the pump monitoring and notification system 68. For example, the second processor 81 may receive the acceleration data from the accelerometer 64 and process the acceleration data to determine RMS acceleration data for specified time windows or time periods. In one example, the second processor 81 may process the acceleration data in time windows that are 1-2 ms long. The RMS acceleration data for each time window may then be transmitted to the first processor 80 and utilized by the pump monitoring and notification system 68 to perform the desired fault analysis. For example, the RMS acceleration data that may be subsequently used to determine the RMS average acceleration and RMS peak-to-peak values for other time windows or time periods such as once each pump revolution.

In other words, the second processor 81 may pre-process the raw acceleration data from the accelerometer 64 and convert or process the data so that it may be subsequently used by a slower operating portion of the controller 61 (e.g., the first processor 80) to determine whether a fault condition exists together with the type of fault. In addition or in the alternative, it may be desirable to utilize the second processor 81 to reduce the amount of data received by the remaining portion of the controller 61 so that less storage may be required.

In order to reduce the likelihood of false warnings or alerts, the pump monitoring and notification system 68 may be configured to require the fault threshold to be met or exceeded for a predetermined time period. In one example, the pump monitoring and notification system 68 may require the fault threshold to be met or exceeded for a time threshold of 60 seconds before generating an alert signal. In other examples, the pump monitoring and notification system 68 may require the fault threshold to be met or exceed for longer or shorter periods of time. For example, the time threshold may be 30 seconds, 120 seconds, or any other desired time period.

If desired, the pump monitoring and notification system 68 may include, in addition or in the alternative, an accumulator function to account for the extent or degree to which the fault threshold is exceeded. The accumulator function may integrate the extent to which the fault threshold is exceeded and establish an additional or accumulator threshold for the accumulator function. The accumulator function may sum the amount by which the fault threshold is exceeded and the sum or accumulated result compared to the accumulator threshold. Upon exceeding the accumulator threshold, the pump monitoring and notification system 68 may determine the type of fault condition and then generate the appropriate (i.e., leak or cavitation) alert signal.

As an example, the pump monitoring and notification system 68 may be configured to permit the hydraulic pump 14 to operate for a relatively long period of time before generating an alert signal if the fault threshold is exceeded by a relatively small amount (e.g., 10%). However, the pump monitoring and notification system 68 may generate an alert signal relatively quickly if the fault threshold is exceeded by a relatively large amount (e.g., 75%).

Alert signals generated by the pump monitoring and notification system 68 may take any desired form. In one example, an alert signal may provide a notice or warning to personnel or systems at the work site and/or remote from the work site and include a designation or communication as to whether the fault is a leak or cavitation. In another example, an alert signal may, in addition or in the alternative, include a command to shutdown or reduce the operation of the pumping system 10 in order to reduce the likelihood of further damage to the hydraulic pump 14.

Figure 4:
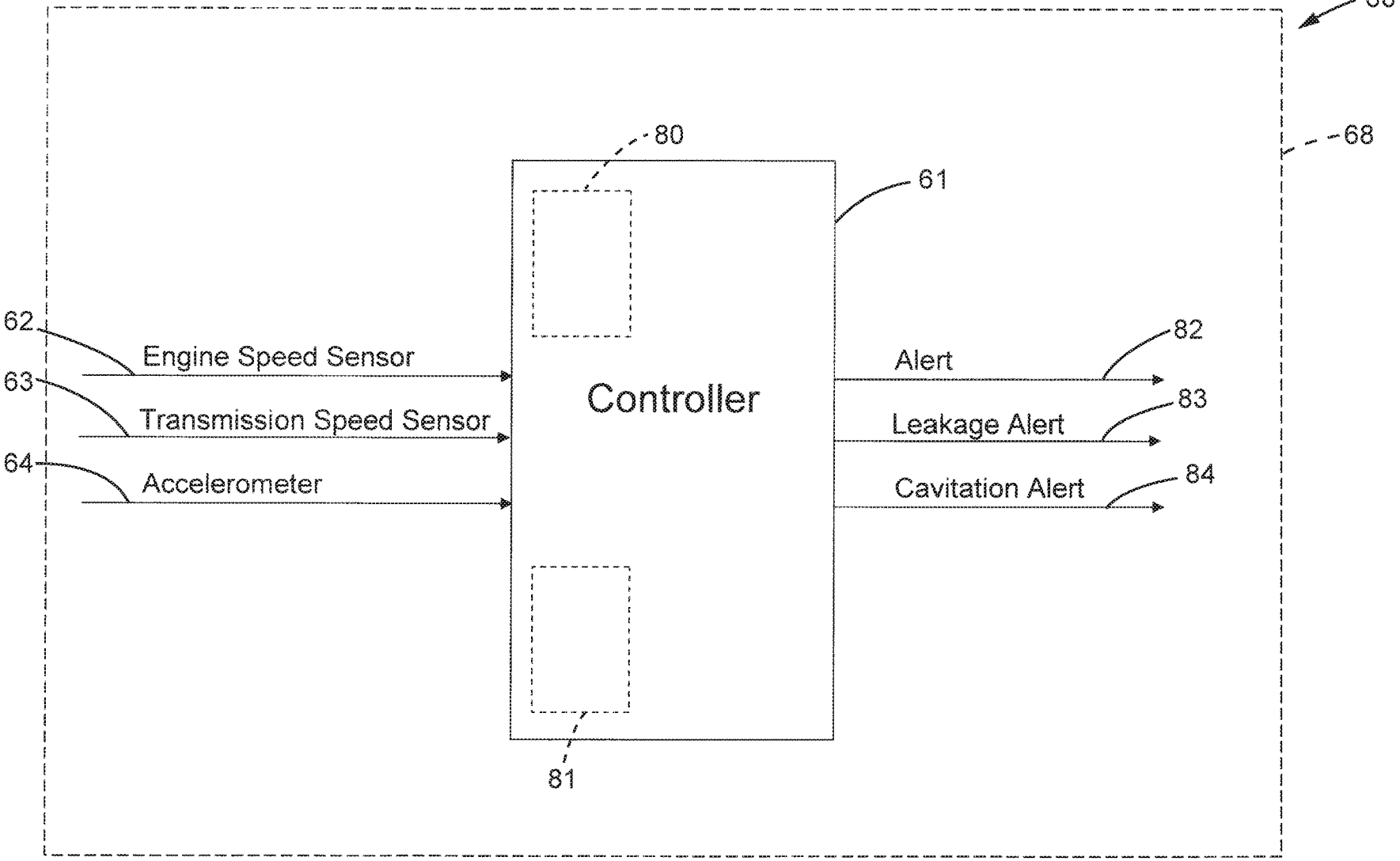
FIG. 4 is a block diagram of a pump monitoring and notification system in accordance with the disclosure.

As depicted in FIG. 4, the controller 61 may receive data from the engine speed sensor 62 to determine the rotational speed of the engine 12 and receive data from the transmission speed sensor 63 to determine the rotational speed of the transmission 13. Input from both of the engine speed sensor 62 and the transmission speed sensor 63 may not be necessary but both are included in FIG. 4 for the sake of completeness. The controller may also receive acceleration data from the accelerometer 64. Upon the pumping system 10 operating at a steady state condition, the pump monitoring and notification system 68 may generate an alert signal 82 when the RMS average acceleration exceeds the fault threshold and may further, or in the alternative, generate a leakage alert signal 83 when the RMS peak-to-peak value exceeds the differentiation threshold and a cavitation alert signal 84 when the RMS peak-to-peak value is less than the differentiation threshold. In some instances, the pump monitoring and notification system 68 may be configured to require the RMS average acceleration to exceed the fault threshold for a predetermined time threshold.

INDUSTRIAL APPLICABILITY

The industrial applicability of the system described herein will be readily appreciated from the foregoing discussion. The pump monitoring and notification system 68 may be used with pumping systems 10 that include a hydraulic pump 14. The pump monitoring and notification system 68 may determine whether the hydraulic pump 14 is experiencing a fault condition and identify the fault condition as leakage or cavitation based upon the acceleration of an accelerometer 64 mounted on the fluid section 30 or components mounted thereon or thereto without monitoring additional aspects or operating characteristics of the pump.

Figure 10:
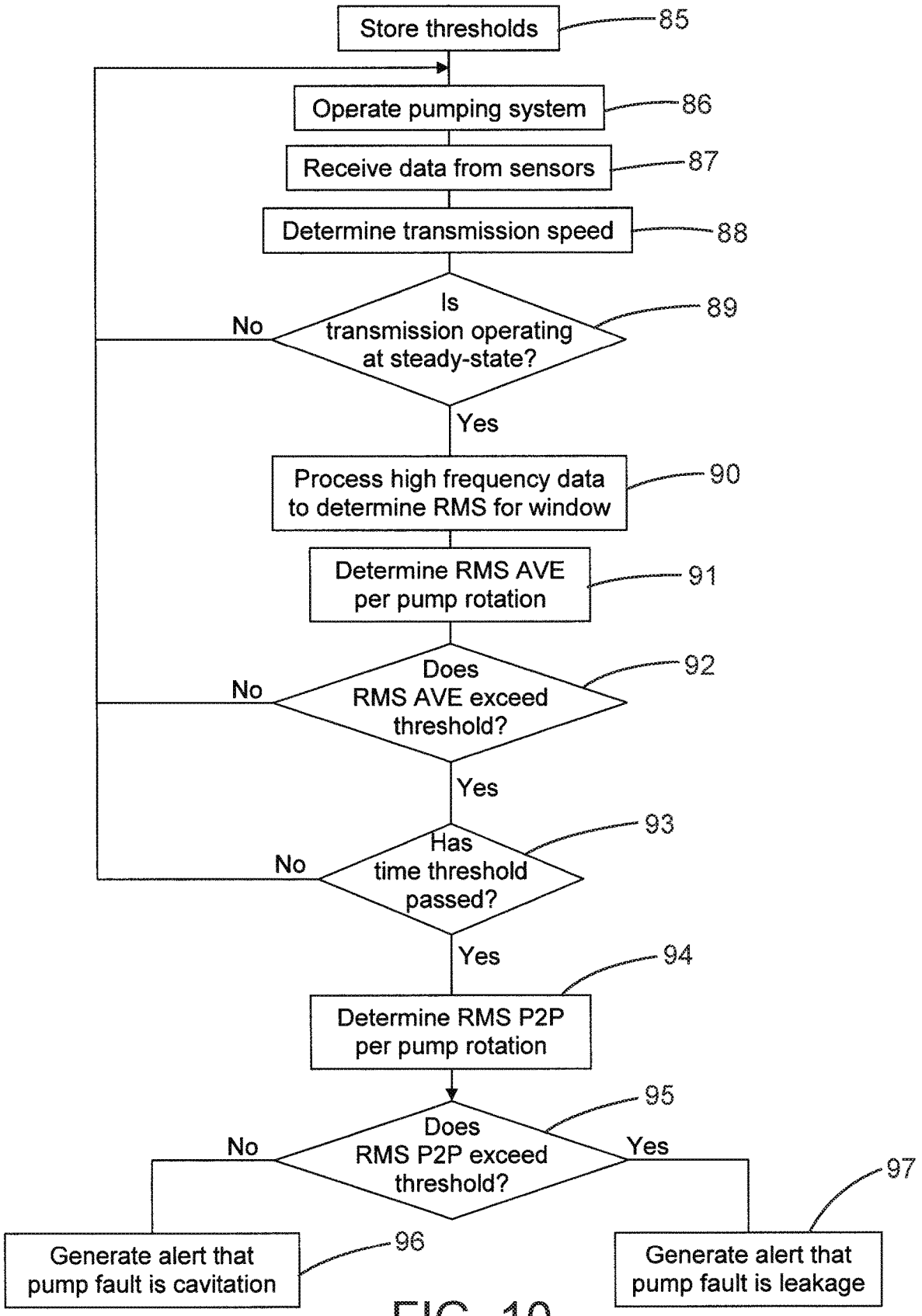
FIG. 10 is a flowchart of a process of operating the pump monitoring and notification system.

FIG. 10 depicts one example of the operation of the pump monitoring and notification system 68. At block 85, a plurality of thresholds may be set or stored. The thresholds may include the fault threshold, the differentiation threshold, a threshold for determining steady state operation of the pumping system such as an engine speed variation threshold or a transmission speed variation threshold, and a time threshold or period of time that the RMS average acceleration of the accelerometer 64 must exceed the fault threshold.

The pumping system 10 may be operated at block 86. Data from the transmission speed sensor 63, or any other sensors for determining steady state operation of the pumping system 10, and the accelerometer 64 may be received at block 87. At block 88, the controller 61 may determine the transmission speed based upon the transmission speed data received from the transmission speed sensor 63. Upon determining the transmission speed, the controller 61 may also determine the pump speed since the transmission is operatively connected to and drives the hydraulic pump 14. The controller 61 may determine at decision block 89 whether the transmission 13 and thus the pumping system 10 are operating at a steady state so that the pump monitoring and notification system 68 may be operated in an accurate manner.

If the pumping system 10 is not operating in a steady state manner, analysis of the acceleration data from the accelerometer 64 may not provide reliable results. Accordingly, when the pumping system 10 is not operating in a steady state manner, the pumping system may continue to be operated and blocks 86-89 repeated.

If the pumping system 10 is operating in a steady state manner, the second processor 81 of the controller 61 may process at block 90 the acceleration data from the accelerometer 64 at a high frequency (e.g., greater than 5 kHz) to determine the RMS acceleration of the accelerometer for each of a plurality of time windows. At block 91, the first processor 80 may utilize the RMS acceleration for a plurality of time windows to determine the RMS average acceleration per pump revolution. The first processor 80 may access the fault threshold 70 and determine at decision block 92 whether the RMS average acceleration per pump revolution exceeds the fault threshold 70 corresponding to the rotational speed of the hydraulic pump 14.

If the RMS average acceleration per pump revolution does not exceed the fault threshold at decision block 92, the pumping system 10 may continue to be operated and blocks 86-92 repeated. If the RMS average acceleration per pump revolution exceeds the fault threshold, the controller 61 may access the time threshold and determine at decision block 93 whether the time during which the RMS average acceleration per pump revolution exceeds the fault threshold also exceeds the time threshold. If the time threshold has not been reached, the pumping system 10 may continue to be operated and blocks 86-93 repeated.

If the time threshold has been reached, the first processor 80 may utilize the RMS acceleration for a plurality of time windows (from block 90) to determine at block 94 the RMS peak-to-peak value per pump revolution. The first processor 80 may access the differential threshold 75 and determine at decision block 95 whether the RMS peak-to-peak value per pump revolution exceeds the differentiation threshold 75 corresponding to the rotational speed of the hydraulic pump 14.

If the RMS peak-to-peak value does not exceed the differentiation threshold 75, the controller 61 may generate a cavitation alert signal at block 96. If the RMS peak-to-peak value exceeds the differentiation threshold 75, the controller 61 may generate a leakage alert signal at block 97. In some instances, under either fault condition, the pumping system 10 may continue to be operated and blocks 86-95 repeated. In other instances, the alert signals may also include a command to shut down or reduce the operation of the pumping system 10.

Other configurations of the operation of the pump monitoring and notification system 68 are contemplated. For example, rather than processing the high frequency acceleration data from the accelerometer 64 to determine the RMS average acceleration for each time window at block 90 and subsequently determining the RMS peak-to-peak acceleration value for each pump rotation at block 94 after determining whether the time threshold has passed, the RMS average acceleration and the RMS peak-to-peak acceleration may be determined at the same time. In addition, once the time threshold has been exceeded at decision block 93, a plurality of RMS peak-to-peak values may be compared to the differentiation threshold 75 before determining the type of fault. In another example, the controller 61 may be configured with a single processor having the capability to sample the acceleration data at a sufficiently high speed (e.g., at least 5 kHz) and also have sufficient capability to process and store the necessary data to operate the pump monitoring and notification system 68. In still another example, the pump monitoring and notification system 68 may use only one of the RMS average acceleration to determine that fault condition exists or the RMS peak-to-peak value to determine the type of fault condition.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A pump monitoring and notification system for a hydraulic pump, comprising: an accelerometer associated with the hydraulic pump, the accelerometer disposed relative to the hydraulic pump to generate acceleration data indicative of acceleration of the hydraulic pump; and a controller configured to: access a fault threshold; access a time threshold; determine an acceleration of the accelerometer based upon the acceleration data from the accelerometer; determine an RMS average, which is a root-mean-square, of the acceleration of the accelerometer based upon the acceleration of the hydraulic pump; compare the RMS average of the acceleration of the accelerometer to the fault threshold; access a differentiation threshold, determine an RMS peak-to-peak value of the acceleration of the accelerometer based upon the acceleration of the hydraulic pump, compare the RMS peak-to-peak value of the acceleration of the accelerometer to the differentiation threshold; generate an alert signal when the RMS average of the acceleration of the accelerometer exceeds the fault threshold for a time period exceeding the time threshold and when the RMS peak-to-peak value of the acceleration of the accelerometer exceeds the differentiation threshold.

2. The pump monitoring and notification system of claim 1, wherein the controller is further configured to determine the RMS average of the acceleration of the accelerometer for a plurality of predetermined time periods.

3. The pump monitoring and notification system of claim 2, wherein each of the plurality of predetermined time periods corresponds to a time for each rotation of the hydraulic pump.

4. The pump monitoring and notification system of claim 1, wherein the controller is further configured to generate a cavitation alert signal when the RMS peak-to-peak value of the acceleration of the accelerometer is equal to or less than the differentiation threshold.

5. The pump monitoring and notification system of claim 1, wherein the controller if further configured to determine the RMS peak-to-peak value of the acceleration for the time period.

6. The pump monitoring and notification system of claim 1, wherein a sampling rate of the acceleration data is at least at 5 kHz.

7. The pump monitoring and notification system of claim 6, wherein the controller is further configured to determine an RMS acceleration for each of a plurality of first time periods and determine the RMS average for each of a plurality of second time periods, each second time period being longer than each first time period.

8. The pump monitoring and notification system of claim 7, wherein the controller is further configured to determine the RMS peak-to-peak value for each second time period.

9. The pump monitoring and notification system of claim 1, wherein the controller includes a first processor and a second processor, and the second processor is configured to process the acceleration data at a sampling rate of at least at 5 kHz to determine RMS acceleration for a plurality of first time periods, each first time period having an identical length, and the first processor is configured to process the RMS acceleration for each first time period at a slower rate than the second processor to determine the RMS average for a plurality of second time periods, each second time period having an identical length and each second time period being longer than each first time period.

10. The pump monitoring and notification system of claim 1, wherein the controller is further configured to only generate an alert signal if the hydraulic pump is operating at a steady state.

11. The pump monitoring and notification system of claim 1, wherein the accelerometer is disposed on a manifold operatively connected to the hydraulic pump.

12. A pumping system comprising:

a prime mover;

a transmission operatively connected to and driven by the prime mover;

a hydraulic pump operatively connected to and driven by the transmission;

an accelerometer associated with the hydraulic pump, the accelerometer disposed relative to the hydraulic pump to generate acceleration data indicative of acceleration of the hydraulic pump; and a controller configured to:

access a fault threshold;

access a differentiation threshold;

access a time threshold;

determine an acceleration of the accelerometer based upon the acceleration data from the accelerometer;

determine an RMS average, which is a root-mean-square, of the acceleration based upon the acceleration of the hydraulic pump;

compare the RMS average of the acceleration of the accelerometer to the fault threshold; and when the RMS average of the acceleration of the accelerometer exceeds the fault threshold for a time period exceeding the time threshold, determine an RMS peak-to-peak value of the acceleration of the accelerometer based upon the acceleration of the hydraulic pump;

compare the RMS peak-to-peak value of the acceleration of the accelerometer to the differentiation threshold; and generate a leak alert signal when the RMS peak-to-peak value of the acceleration of the accelerometer exceeds the differentiation threshold and generate a cavitation alert signal when the RMS peak-to-peak value is less than the differentiation threshold.

* * * * *